US009970377B2

(12) United States Patent
Carboni et al.

(10) Patent No.: US 9,970,377 B2
(45) Date of Patent: May 15, 2018

(54) METHOD OF CORRECTING A STANDARD CHARACTERISTIC CURVE OF A STANDARD FUEL INJECTOR OF AN INTERNAL COMBUSTION ENGINE

(71) Applicant: GM GLOBAL TECHNOLOGY OPERATIONS LLC, Detroit, MI (US)

(72) Inventors: Daniele Carboni, Turin (IT); Antonio Arpaia, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days. days.

(21) Appl. No.: 15/195,311

(22) Filed: Jun. 28, 2016

(65) Prior Publication Data

US 2016/0377011 A1 Dec. 29, 2016

(30) Foreign Application Priority Data

Jun. 29, 2015 (GB) ..... 1511404.4

(51) Int. Cl.
*F02D 41/40* (2006.01)
*F02D 41/24* (2006.01)
*F02D 41/20* (2006.01)

(52) U.S. Cl.
CPC ..... *F02D 41/2467* (2013.01); *F02D 41/20* (2013.01); *F02D 2041/2055* (2013.01); *F02D 2200/0614* (2013.01)

(58) Field of Classification Search
CPC ..... F02D 41/2467; F02D 41/20; F02D 41/40; F02D 41/401; F02D 41/402; F02D 2041/2055; F02D 2200/0614
USPC ..... 123/299, 300, 490; 701/103, 104, 105
See application file for complete search history.

(56) References Cited

U.S. PATENT DOCUMENTS 5,265,576 A 11/1993 McMahon et al.
7,881,857 B2 * 2/2011 Samenfink ..... F02D 41/1454 123/299
2009/0043482 A1 2/2009 Speetzen et al.

OTHER PUBLICATIONS

Great Britain Patent Office, Great Britain Search Report for Great Britain Application No. 1511404.4, dated Dec. 21, 2015.

* cited by examiner

*Primary Examiner* — Hai Huynh
(74) *Attorney, Agent, or Firm* — Lorenz & Kopf LLP

(57) ABSTRACT

A method and controller provide a corrected standard characteristic curve for a fuel injector to inject fuel into an internal combustion engine. A minimum fuel injector energizing time is determined where a predetermined parameter based upon a plurality of fuel injector energizing times and a plurality of master fuel injector energizing times is a minimum. An energizing time correction value is the difference between a reference energizing time and the minimum energizing time. The standard characteristic curve is corrected based on the energizing time correction value.

11 Claims, 5 Drawing Sheets

METHOD OF CORRECTING A STANDARD CHARACTERISTIC CURVE OF A STANDARD FUEL INJECTOR OF AN INTERNAL COMBUSTION ENGINE

CROSS-REFERENCE TO RELATED APPLICATION

This application claims priority to Great Britain Patent Application No. 1511404.4, filed Jun. 29, 2015, which is incorporated herein by reference in its entirety.

TECHNICAL FIELD

The present disclosure pertains to a method of correcting a standard characteristic curve of a standard fuel injector of an internal combustion engine.

BACKGROUND

It is known that internal combustion engines are equipped with so-called standard fuel injectors to inject metered quantities of fuel into the cylinders of the engine. Each standard fuel injector performs according to a standard characteristic curve that represents a correlation between an energizing time during which the standard fuel injector is energized and a fuel quantity injected by the standard fuel injector into a cylinder of the internal combustion engine. Due to the production spread and tolerances, the standard characteristic curve of each standard fuel injector is generally different from the others.

In order to guarantee substantially the same performances, it is therefore necessary to properly correct the standard characteristic curve of each individual standard fuel injector. A known strategy to achieve this task provides for testing a so called master fuel injector at the end of the production line, in order to determine a master characteristic curve of the master injector, and then of correcting the standard characteristic curve of each individual standard fuel injector with a correction factor derived from the main characteristic curve. This correction factor may be expressed in terms of a fuel quantity correction or in terms of an energizing time correction.

However, these correction strategies are based on the assumption that the standard characteristic curves have the same slope of the master characteristic curve. Therefore only in this special case, the effectiveness of the known correction strategies is actually guaranteed.

SUMMARY

The present disclosure provides a correction method of the standard characteristic curves of the standard injectors that, for example at end of an injector's assembly line, is capable of better compensating the errors that may be caused by the differences between the slope of the standard characteristic curves and the slope of the master characteristic curve.

An embodiment of the present disclosure provides a method of correcting a standard characteristic curve of a standard fuel injector of an internal combustion engine. The standard characteristic curve represents a correlation between an energizing time during which the standard fuel injector is energized and a fuel quantity injected by the standard fuel injector into a cylinder of the internal combustion engine. The standard characteristic curve is used to inject metered quantities of fuel by the standard fuel injector.

A first associated injected fuel quantity and a second associated injected fuel quantity corresponding to an energizing time which is higher than a reference energizing time by a time interval is determined from the standard characteristic curve. A standard fuel quantity increment is calculated as the difference between the second and the first injected fuel quantities associated to the reference energizing time. A first associated injected fuel quantity and a second associated injected fuel quantity corresponding to an energizing time which is higher than the energizing time by the time interval is determined from a master characteristic curve for each one of a plurality of energizing times. A master fuel quantity increment is calculated for each one of the plurality of the energizing times as the difference between the second and the first injected fuel quantities associated to the energizing time, a difference between the master fuel quantity increment and the standard fuel quantity increment, and a value of a predetermined parameter as a function of the difference. The energizing time for which the value of the parameter is a minimum is identified among the plurality of energizing time. An energizing time correction value is calculated as a difference between the reference energizing time and the identified energizing time. The energizing time correction value is used to correct the standard characteristic curve.

An effect of this embodiment is that, by considering the minimum of a parameter which is a function of the difference between the master fuel quantity increment and the standard fuel quantity increment, the disclosed solution is able to identify an energizing time value in correspondence of which the slope of the master characteristic curve coincides, or almost coincides, with the slope of the standard characteristic curve in correspondence of the reference energizing time. As a consequence, the energizing time correction, which is calculated as the difference between the reference energizing time and the identified energizing time, obtains a corrected standard characteristic curve that adheres to the master characteristic curve better than the curves obtained by the conventional correction strategies. When used for operating the standard injections, the standard characteristic curves obtained with the instant solution are thus able to better compensate the injector to injector production spread, thereby achieving multiple benefits, including an enhanced emission calibration robustness, the possibility of performing smaller pilot injections and therefore of reducing smoke emission and combustion noise and generally a positive environmental impact by minimizing engine emissions.

According to an aspect of this embodiment of the present disclosure, the value of the aforementioned predetermined parameter may be calculated as the square of the difference between the master fuel quantity increment and the standard fuel quantity increment. The calculation of this parameter provides a reliable index of similarity between the slope of the master characteristic curve and the slope of the standard characteristic curve.

According to another embodiment of the present disclosure, the method may further determine from the standard characteristic curve, and for the reference energizing time, a third associated injected fuel quantity corresponding to an energizing time which is lower than the reference energizing time by the time interval. A standard fuel quantity decrement is calculated as the difference between the first and the third injected fuel quantities associated to the reference energizing time. From the master characteristic curve, and for each one of the plurality of reference energizing times, a third associated injected fuel quantity corresponding to an energizing time which is lower than the energizing time by the time interval is determined. For each one of the plurality of energizing times, a master fuel quantity decrement is calculated as the difference between the first and the third injected fuel quantities associated to the energizing time, a difference between the master fuel quantity decrement and the standard fuel quantity decrement, and the value of the predetermined parameter as a function of both the difference between the master fuel quantity increment and the standard fuel quantity increment and the difference between the master fuel quantity decrement and the standard fuel quantity decrement.

An effect of this embodiment is that, by considering the minimum of a parameter which is a function of both the differences mentioned above, the identification of the energizing time value, in correspondence of which the slope of the master characteristic curve coincides, or almost coincides, with the slope of the standard characteristic curve in correspondence of the reference energizing time, becomes more robust, thereby improving the reliability of the entire correction strategy.

According to an aspect of this embodiment of the present disclosure, the value of the aforementioned predetermined parameter may be calculated as a sum of the square of the difference between the master fuel quantity d the standard fuel quantity increment and the square of the difference between the master fuel quantity decrement and the standard fuel quantity decrement. The calculation of this parameter provides a more reliable index of similarity between the slope of the master characteristic curve and the slope of the standard characteristic curve.

According to a different aspect of the present disclosure, the method may further calculate a fuel quantity correction value as a difference between the first injected fuel quantity associated from the master characteristic curve to the identified reference energizing time and the first injected fuel quantity associated from the standard characteristic curve to the reference energizing time. The fuel quantity correction value is used for correcting the standard characteristic curve. An effect of this aspect is that of allowing an effective correction of the standard characteristic curve of the standard fuel injector even in case that such curve presents errors on both the fuel quantity and the energizing time axis with respect to the master characteristic curve.

The present disclosure may be also embodied in the form of a computer program including a computer-code for performing, when run on a computer, the correction method described above, or in the form of a computer program product including a carrier on which the computer program is stored. In particular, the present disclosure may be embodied in the form of a control apparatus for an internal combustion engine, including an electronic control unit, a data carrier associated to the electronic control unit and the computer program stored in the data carrier. Another embodiment may provide an electromagnetic signal modulated to carry a sequence of data bits which represent the computer program.

Another embodiment of the present disclosure provides an apparatus for correcting a standard characteristic curve of a standard fuel injector of an internal combustion engine, the standard characteristic curve representing a correlation between an energizing time during which the standard fuel injector is energized and a fuel quantity injected by the standard fuel injector into a cylinder of the internal combustion engine, the standard characteristic curve being used to inject metered quantities of fuel by the standard fuel injector. The control apparatus or other means is configured to determine, from the standard characteristic curve, and for a reference energizing time, a first associated injected fuel quantity and a second associated injected fuel quantity corresponding to an energizing time which is higher than the reference energizing time by a time interval; to calculate a standard fuel quantity increment as the difference between the second and the first injected fuel quantities associated to the reference energizing time; to determine, from a master characteristic curve and for each one of a plurality of energizing times, a first associated injected fuel quantity and a second associated injected fuel quantity corresponding to an energizing time which is higher than the energizing time by the time interval; to calculate, for each one of the plurality of the energizing times, a master fuel quantity increment as the difference between the second and the first injected fuel quantities associated to the energizing time, a difference between the master fuel quantity increment and the standard fuel quantity increment, and a value of a predetermined parameter as a function of the difference; to identify, among the plurality of energizing time, the energizing time for which the value of the function is minimum; to calculate an energizing time correction value as a difference between the reference energizing time and the identified energizing time; and to use the energizing time correction value for correcting the standard characteristic curve.

This embodiment achieves basically the same effects of the method above, in particular that of obtaining a corrected standard characteristic curve that adheres to the master characteristic curve better than the curves obtained by the conventional correction strategies.

According to an aspect of this embodiment, the value of the aforementioned predetermined parameter may be calculated as the square of the difference between the master fuel quantity increment and the standard fuel quantity increment. The calculation of this parameter provides a reliable index of similarity between the slope of the master characteristic curve and the slope of the standard characteristic curve.

According to another embodiment of the present disclosure, the control apparatus or other means is configured to determine, from the standard characteristic curve, and for the reference energizing time, a third associated injected fuel quantity corresponding to an energizing time which is lower than the reference energizing time by the time interval; to calculate a standard fuel quantity decrement as the difference between the first and the third injected fuel quantities associated to the reference energizing time; to determine, from the master characteristic curve, and for each one of the plurality of reference energizing times, a third associated injected fuel quantity corresponding to an energizing time which is lower than the energizing time by the time interval; and to calculate, for each one of the plurality of energizing times, a master fuel quantity decrement as the difference between the first and the third injected fuel quantities associated to the energizing time, a difference between the master fuel quantity decrement and the standard fuel quantity decrement, and the value of the predetermined parameter as a function of both the difference between the master fuel quantity increment and the standard fuel quantity increment and the difference between the master fuel quantity decrement and the standard fuel quantity decrement.

An effect of this embodiment is that the identification of the energizing time value, in correspondence of which the slope of the master characteristic curve coincides, or almost coincides, with the slope of the standard characteristic curve in correspondence of the reference energizing time, becomes more robust, thereby improving the reliability of the entire correction strategy.

According to an aspect of this embodiment of the present disclosure, the value of the aforementioned predetermined parameter may be calculated as a sum of the square of the difference between the master fuel quantity increment and the standard fuel quantity increment and the square of the difference between the master fuel quantity decrement and the standard fuel quantity decrement. The calculation of this parameter provides a more reliable index of similarity between the slope of the master characteristic curve and the slope of the standard characteristic curve.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
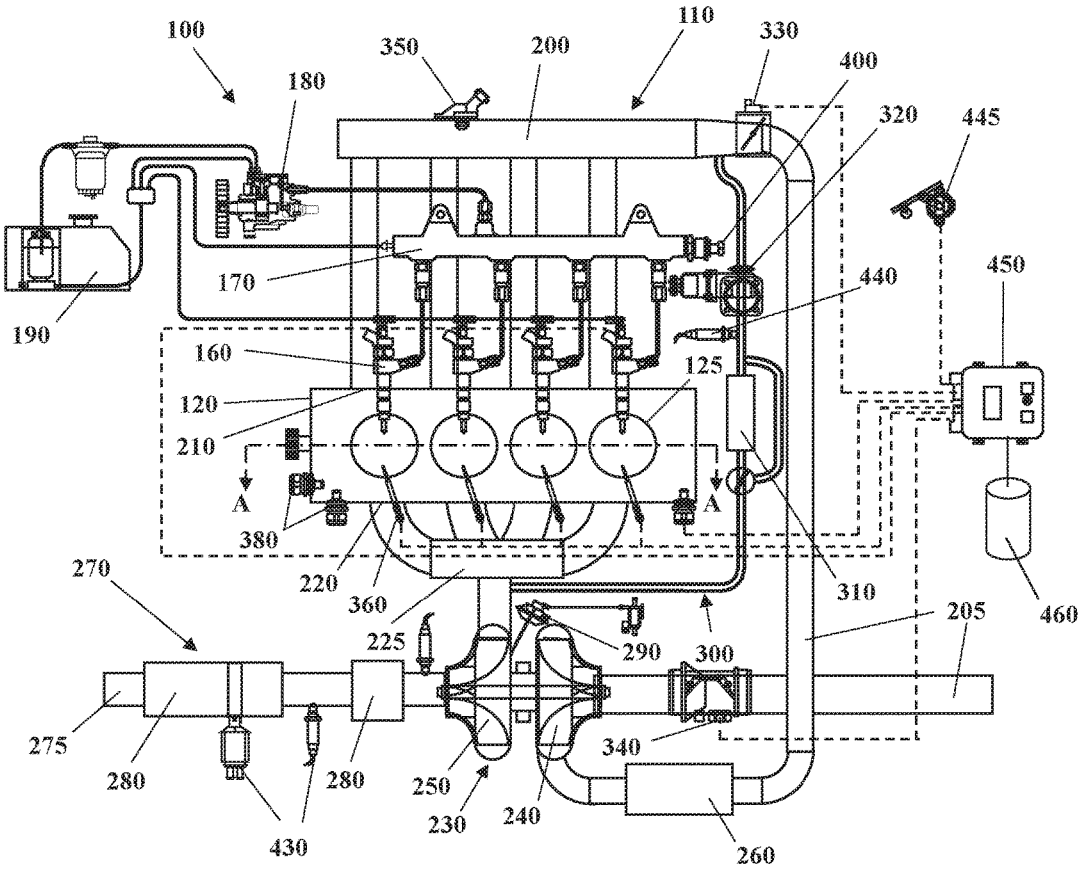
FIG. 1 shows an automotive system.
Figure 2:
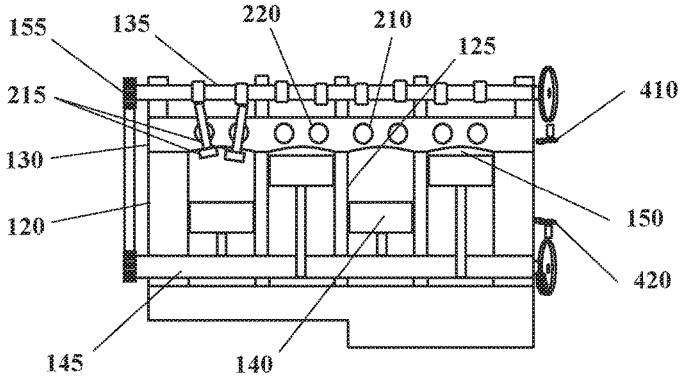
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases exit the turbine 250 and are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean NOx traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion.

Outside the automotive system 100 it is normally visible as a computer program product, which is also called computer readable medium or machine readable medium in the art, and which should be understood to be a computer program code residing on a carrier, the carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing the computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic for carrying out each step of the method of correcting a standard characteristic curve for a standard fuel injector as discussed above, e.g. an embedded controller, an onboard computer, or any processing module that might be deployed in the vehicle.

Figure 4:
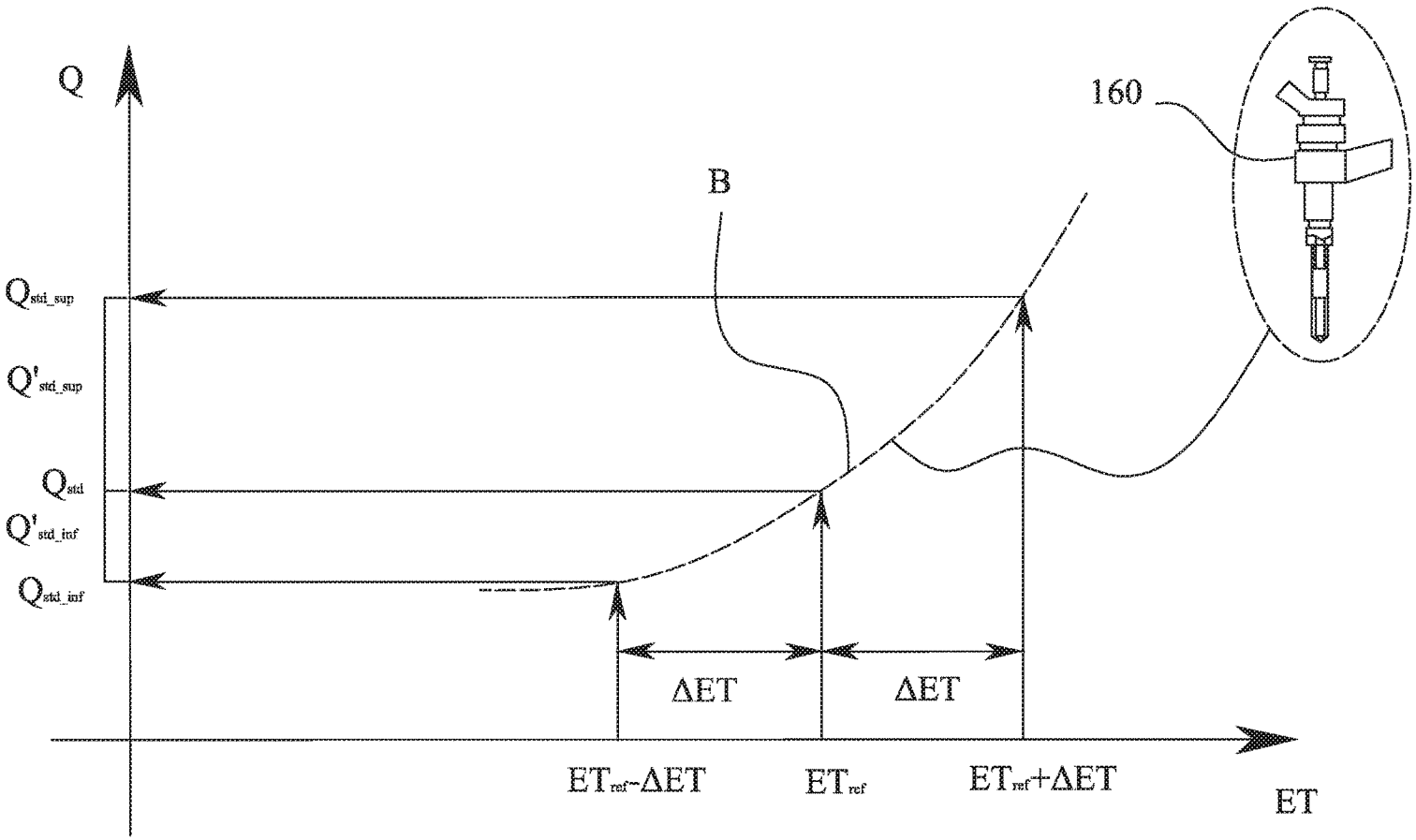
FIG. 4 is a graph representing a standard characteristic curve of a standard fuel injector.

Each one of the fuel injectors 160, also referred as standard fuel injectors, may be operated by the ECU 450 by a dedicated standard characteristic curve B, as shown in FIG. 4, which represents a correlation between an energizing time during which the standard fuel injector 160 is energized and a fuel quantity injected by the standard fuel injector 160 into the corresponding cylinder 125 of the internal combustion engine 110.

By way of example, the ECU 450 may be configured to determine a target value of the fuel quantity to be injected into the cylinder 125, to obtain from the standard characteristic curve B the energizing time associated to the target value of the injected fuel quantity and then to energize the standard fuel injector 160 for a time period corresponding to that energizing time.

The standard characteristic curve B may be determined for each individual standard fuel injector 160, for example at the end of the production line, by an experimental activity that provides for energizing the standard fuel injector 160 for a predetermined energizing time and for measuring the fuel quantity injected during that period. This test is repeated a small number of times (e.g. three times), using each time a different value of the energizing time, in order to obtain a corresponding number of values of the injected fuel quantity and thus a corresponding number of real point of the standard characteristic curve B. The standard characteristic curve B may be finally obtained by interpolating these real points.

In this way, the standard characteristic curve B represents a low-definition function $Q_{std}=f_{sid}$ (ET) that correlates energizing time values ET applied to the standard fuel injector 160 to corresponding fuel quantities $Q_{std}$ injected by the standard fuel injector 160, and vice versa.

In order to compensate the production drifts and to guarantee that the performances of the standard fuel injectors 160 are substantially the same, the standard characteristic curve B of each one of them needs to be corrected. This correction may be performed with the aid of a so called master fuel injector 160'.

Figure 3:
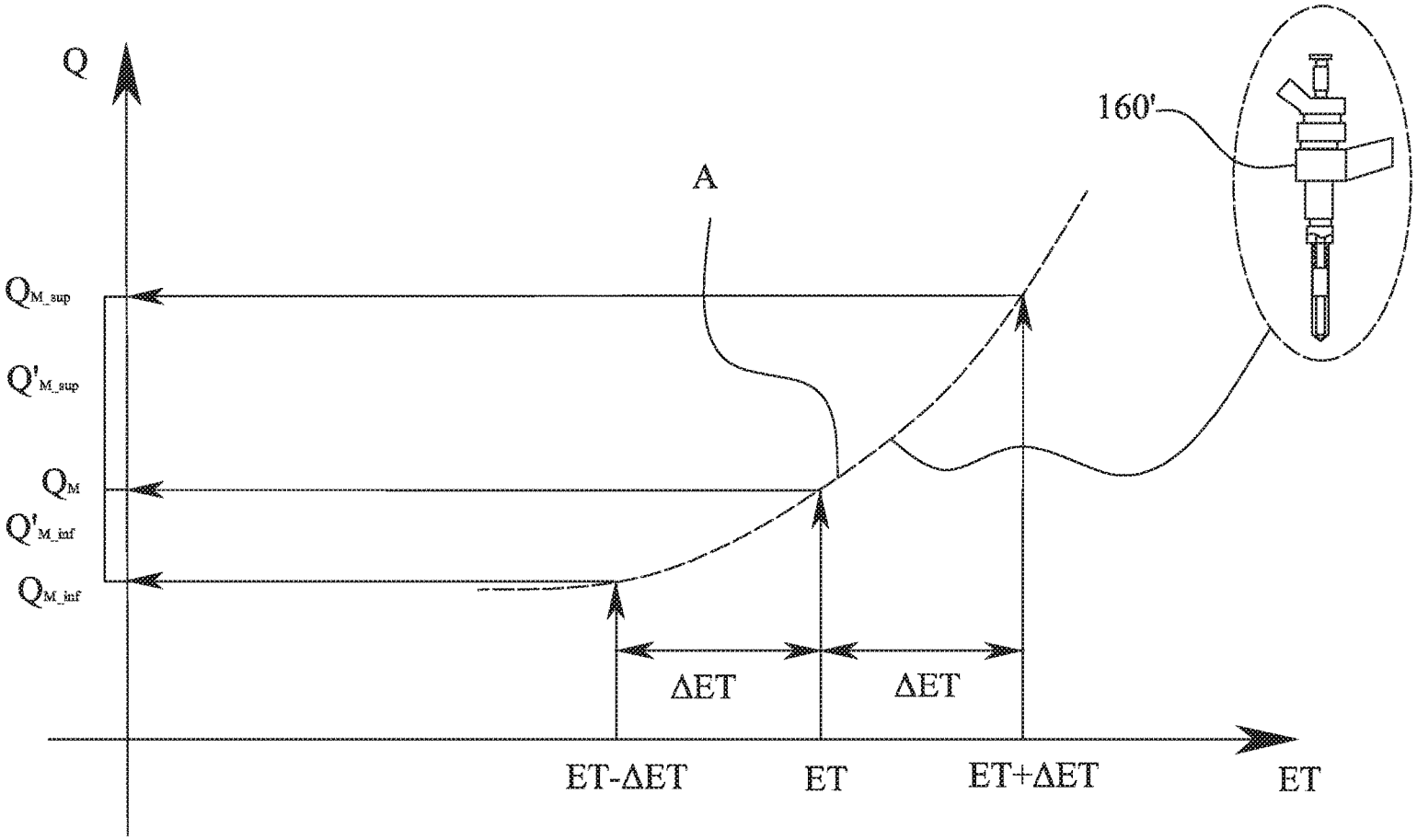
FIG. 3 is a graph representing a master characteristic curve of a master fuel injector.

As known in the art, the master fuel injector 160' is a reference fuel injector of the same kind of the standard injectors 160 which is experimentally tested, for example at the end of the production line, in order to obtain a master characteristic curve A, as shown in FIG. 3, which is more precise than anyone of the standard characteristic curves B.

To obtain the master characteristic curve A, the master fuel injector 160' is basically subjected to the same experimental activity described above for the standard fuel injectors 160, which provides for energizing the master fuel injector 160 for a predetermined energizing time and for measuring the fuel quantity injected during that period. However, differently from the standard fuel injectors 160, this test is repeated a larger number of times (e.g. fifty times or more), using each time a different value of the energizing time, in order to obtain a corresponding large number of values of the injected fuel quantity and thus a corresponding large number of real points of the characteristic curve.

In this way, the master characteristic curve A represents a high-definition function $Q_M=f$ (ET) that correlates energizing time values ET applied to the master fuel injector 160' to corresponding fuel quantities $Q_M$ injected by the master fuel injector 160', and vice versa.

The master characteristic curve A represents also a desired characteristic curve which is used for correcting the characteristic curve B of each standard fuel injector 160, according to the correction strategy described below.

Figure 8:
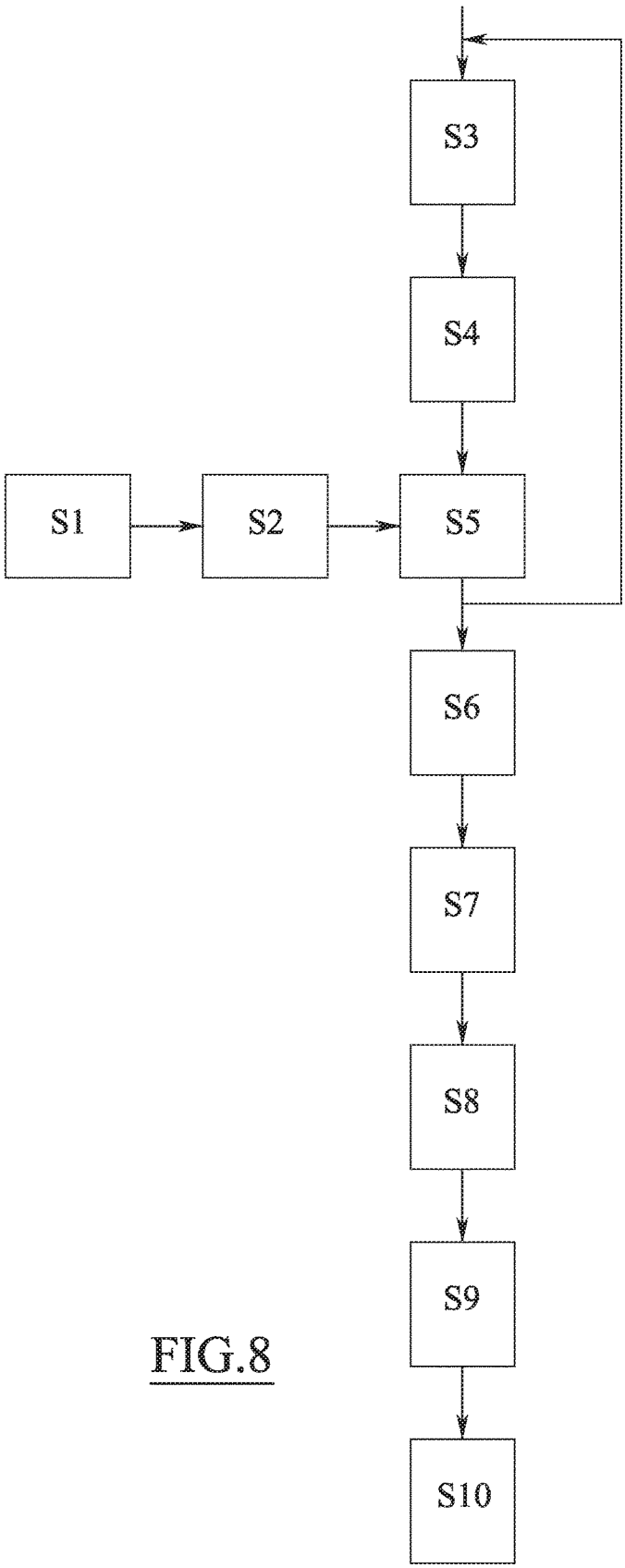
FIG. 8 is a flowchart representing a method of correcting the standard characteristic curve of FIG. 4 according to an embodiment of the present disclosure.

Referring to FIGS. 4 and 8, the correction strategy may prescribe of determining (block S1), from the standard characteristic curve B and for a predetermined reference energizing time value $ET_{ref}$, a first associated injected fuel quantity $Q_{std}$, a second associated injected fuel quantity $Q_{std_sup}$ corresponding to an energizing time $ET_{ref}+\Delta ET$ which is higher than the reference energizing time $ET_{ref}$ by a predetermined time interval ΔET, and a third associated injected fuel quantity $Q_{std_inf}$ corresponding to an energizing time $ET_{ref}-\Delta ET$ which is lower than the reference energizing time $ET_{ref}$ by the time interval ΔET.

The correction strategy may then prescribe of calculating (block S2) a standard fuel quantity increment $Q'_{std_sup}$ as the difference between the second $Q_{std_sup}$ and the first $Q_{std}$ injected fuel quantities associated to the reference energizing time $ET_{ref}$, and a standard fuel quantity decrement $Q'_{std_inf}$ as the difference between the first $Q_{std}$ and the third $Q_{std_inf}$ injected fuel quantities associated to the reference energizing time $ET_{ref}$, according to the following equations:

$$Q'_{std_inf}=Q_{std}-Q_{std_inf}=f_{std}(ET_{ref})-f_{std}(ET_{ref}-\Delta ET)$$

$$Q'_{std_sup}=Q_{std_sup}-Q_{std}=f_{std}(ET_{ref}+\Delta ET)-f_{std}(ET_{ref}).$$

Referring now to FIGS. 3 and 8, the correction strategy may further determine (block S3), from the master characteristic curve A and for a predetermined energizing time value ET, a first associated injected fuel quantity $Q_M$, a second associated injected fuel quantity $Q_{M_sup}$ corresponding to an energizing time ET±ΔET which is higher than the energizing time ET by the predetermined time interval ΔET, and a third associated injected fuel quantity $Q_{M_inf}$ corresponding to an energizing time ET−ΔET which is lower than the energizing time ET by the time interval ΔFT.

The correction strategy may then calculate (block S4) a master fuel quantity increment $Q'_{M_sup}$ as the difference between the second $Q_{M_sup}$ and the first $Q_M$ injected fuel quantities associated to the energizing time ET, and a master fuel quantity decrement $Q'_{M_inf}$ as the difference between the first $Q_M$ and the third $Q_{M_inf}$ injected fuel quantities associated to the energizing time ET, according to the following equations:

$$Q'_{M_inf}=Q_M-Q_{M_inf}=f(ET)-f(ET-\Delta ET)$$

$$Q'_{M_sup}=Q_{M_sup}-Q_M=f(ET+\Delta ET)-f(ET).$$

The correction strategy may further calculate (block S5) a difference between the master fuel quantity increment $Q'_{M_sup}$ and the standard fuel quantity increment $Q'_{std_sup}$, a difference between the master fuel quantity decrement $Q'_{M_inf}$ and the standard fuel quantity decrement $Q'_{std_inf}$, and a value of a predetermined parameter $SR^2$ as a function of the differences. In particular, the value of the parameter $SR^2$ may be the sum of the squares of the aforementioned differences according to the following equation:

$$SR^2=(Q'_{std_inf}-Q'_{M_inf})^2+(Q'_{std_sup}-Q'_{M_sup})^2$$

Wherein: $Q'_{std_inf}$ is the standard fuel quantity decrement;
$Q'_{M_inf}$ is the master fuel quantity decrement;
$Q'_{std_sup}$ is the standard fuel quantity increment; and
$Q'_{M_sup}$ is the master fuel quantity increment.

The procedural steps S3, S4 and S5 described above are repeated a large number of times (e.g. fifty times or more), using every time a different value of the energizing time ET, thereby obtaining a corresponding large number of master fuel quantity increments $Q'_{M_sup}$, a corresponding large number of master fuel quantity decrement $Q'_{M_inf}$, and a corresponding large number of values of the parameter $SR^2$.

Figure 5:
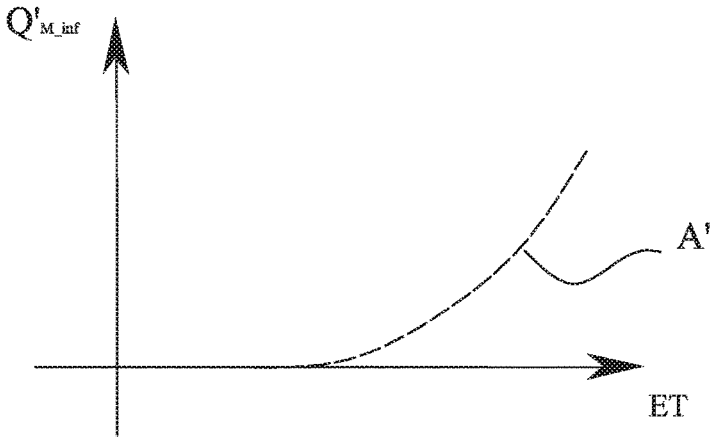
FIGS. 5 and 6 are graphs representing additional characteristic curves of the master injector.
Figure 6:
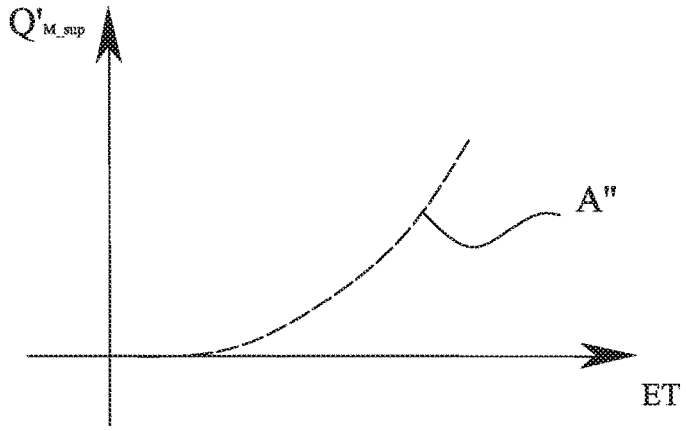

In this way, it is possible to interpolate the master fuel quantity decrements $Q'_{M_inf}$ associated to the different values of the values of the energizing time ET, thereby obtaining a curve A' that represents the variation of the master fuel quantity decrement $Q'_{M_inf}$ in function of the energizing time ET as shown in FIG. 5. Analogously, it is possible to interpolate the master fuel quantity increments $Q'_{M_sup}$ associated to the different values of the values of the energizing time ET, thereby obtaining a curve A" that represents the variation of the master fuel quantity increment $Q'_{M_sup}$, in function of the energizing time ET as shown in FIG. 6. Moreover, it is possible to interpolate the values of the function $SR^2$ associated to the different values of the values of the energizing time ET, thereby obtaining a curve C that represents the variation of the parameter $SR^2$ in response to different values of the energizing time ET as shown in FIG. 7.

Figure 7:
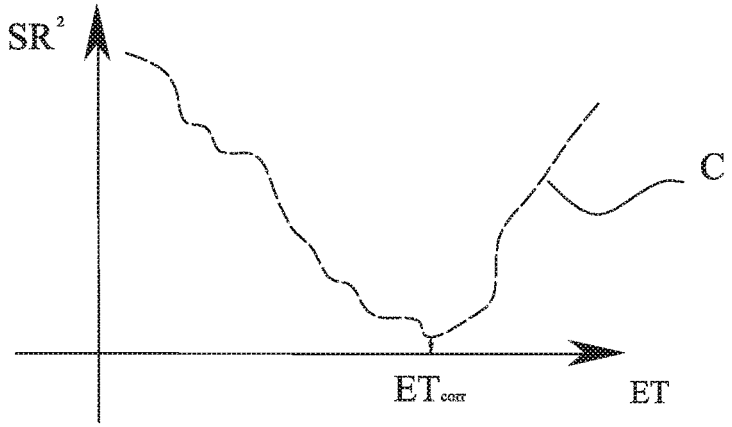
FIG. 7 is a graph representing the variation of a predetermined parameter curve used in an embodiment of the present disclosure.

Referring now to FIG. 7 and FIG. 8, the correction strategy may identify (block S6) the value $ET_{corr}$ of the energizing time ET for which the value of the parameter $SR^2$ is minimum. In other words, among all the values of the energizing time ET that have been used during the repetition of the steps S3, S4 and S5 above, the control strategy identifies the value $ET_{corr}$, that minimizes the parameter $SR^2$. In certain special cases, the energizing time value $E_{corr}$ may correspond to the value of the energizing time for which the value of the function $SR^2$ is zero. These cases arise when the following condition apply:

$$Q'_{std_inf}(ET_{ref})=Q'_{M_inf}(ET_{corr})$$

and $$Q'_{std_sup}(ET_{ref})=Q'_{M_sup}(ET_{corr})$$

Knowing the energizing time value $ET_{corr}$, the correction strategy may prescribe of calculating (block S7) an energizing time correction value $dET_{corr}$ by means of the following equation:

$$dET_{corr}ET_{corr}-ET_{ref}$$

and, possibly, also a fuel quantity correction value $dQ_{corr}$ may be calculated (block S8) by means of the following equation:

$$dQ_{corr}=Q_M(ET_{corr})-Q_{std}(ET_{ref}),$$

wherein: $Q_M(ET_{corr})$ is the fuel quantity value correlated from the master characteristic curve A to the energizing time value $ET_{corr}$, and $Q_{std}(ET_{ref})$ is the fuel quantity value correlated from the standard characteristic curve B to the reference energizing time value $ET_{ref}$.

In this way, for each standard fuel injector 160, two correction values may be calculated, namely $dET_{corr}$ and $dQ_{corr}$. These correction values may be finally used to correct the standard characteristic curve B of the standard fuel injector 160 (block S9). In particular, referring to FIG. 4, the standard characteristic curve B may be shifted of a quantity corresponding to $dET_{corr}$ along the axis ET and of a quantity corresponding to $dQ_{corr}$ along the axis Q.

In some embodiments, the above-described correction strategy may be repeated for more than one reference energizing time value $ET_{ref}$ of the standard characteristic curve B (e.g. for three different energizing time values $ET_{ref}$), thereby obtaining a corresponding number of couples of correction values $dET_{corr}$ and $dQ_{corr}$, each of which may be used to correct the standard characteristic curve B locally in the boundary of the corresponding energizing time reference value $ET_{ref}$.

As already mentioned, the corrected standard characteristic curve B of the standard fuel injector 160 may be finally stored in the data carrier 460 associated with the ECU 450 and used by the ECU 450 to operate the standard fuel injector 160 (block S10) as explained above, for example by determining from the corrected standard characteristic curve B the energizing time value that corresponds to a target value of the fuel injected quantity and then energizing the standard fuel injector 160 accordingly.

According to a simplified embodiment of the solution, the computational effort necessary to perform the correction may be reduced by modifying some of the procedural steps described above. With regard to the steps S1 and S2, the simplified embodiment may for example determine, from the standard characteristic curve B and for the predetermined reference energizing time value $ET_{ref}$, only the first associated injected fuel quantity $Q_{std}$ and the second associated injected fuel quantity $Q_{std_sup}$, and then of calculating only the standard fuel quantity increment $Q'_{std_sup}$ according to the following equation:

$$Q'_{std_sup}=Q_{std_sup}-Q_{std}=f_{std}(ET_{ref}+\Delta ET)-f_{std}(ET_{ref}).$$

Correspondently, with regard to the steps S3, S4 and S5, the simplified embodiment may determine, from the standard characteristic curve B and for each one of the predetermined energizing time value ET, only the first associated injected fuel quantity $Q_M$ and the second associated injected fuel quantity $Q_{M_sup}$, and then of calculating only the master fuel quantity increment $Q'_{M_sup}$ according to the following equation:

$$Q'_{M_sup}=Q_{M_sup}-Q_M=f(ET+\Delta ET)-f(ET),$$

of calculating the difference between the master fuel quantity increment $Q'_{M_sup}$ and the standard fuel quantity increment $Q'_{std_sup}$, and finally of calculating a value of a predetermined simplified parameter $R^2$ as a function of the difference only.

In particular, the value of the simplified parameter $R^2$ may be calculated as the square of the aforementioned difference according to the following equation:

$$R^2=(Q'_{std_inf}-Q'_{M_inf})^2$$

Wherein: $Q'_{std_sup}$ is the standard fuel quantity increment; and $Q'_{M_sup}$ is the master fuel quantity increment.

With regard to the step S6, among all the values of the energizing time ET that have been used during the repetition of the steps S3, S4 and S5, the simplified embodiment may finally identify $ET_{corr}$ as the energizing time value that minimize the simplified parameter $R^2$.

With regard to the remaining steps, the simplified embodiment is the same as the first embodiment described above.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of correcting a standard characteristic curve of a standard fuel injector used to inject metered quantities of fuel into an internal combustion engine, the method comprising:

determining, from the standard characteristic curve, a first injected fuel quantity and a second injected fuel quantity corresponding to an incremented energizing time, which is higher than a reference energizing time by a time interval;

calculating a standard fuel quantity increment as the difference between the first and second injected fuel quantities;

determining, from a master characteristic curve of a master injector, a first master injected fuel quantity and a second master injected fuel quantity corresponding to a plurality of energizing times;

calculating, for each of the plurality of the energizing times, a master fuel quantity increment as the difference between the first and second master injected fuel quantities, a difference between the master fuel quantity increment and the standard fuel quantity increment and a value of a predetermined parameter as a function of at least one the difference;

identifying, among the plurality of energizing times, a minimum energizing time for which the value of the predetermined parameter is a minimum;

calculating an energizing time correction value as a difference between the reference energizing time and the minimum energizing time; and correcting the standard characteristic curve based on the energizing time correction value.

2. The method according to claim 1, wherein the value of the predetermined parameter is calculated as the square of the difference between the master fuel quantity increment and the standard fuel quantity increment.

3. The method according to claim 1, further comprising:

determining, from the standard characteristic curve; a third injected fuel quantity corresponding to a decremented energizing time, which is lower than the reference energizing time by the time interval;

calculating a standard fuel quantity decrement as the difference between the first and third injected fuel quantities;

determining, from the master characteristic curve, and for each one of the plurality of reference energizing times, a third master injected fuel quantity corresponding to the decremented energizing time;

calculating, for each one of the plurality of energizing times, a master fuel quantity decrement as the difference between the first and third injected fuel quantities, a difference between the master fuel quantity decrement and the standard fuel quantity decrement, and the value of the predetermined parameter as a function of both the difference between the maker fuel quantity increment and the standard fuel quantity increment and the difference between the master fuel quantity decrement and the standard fuel quantity decrement.

4. The method according to claim 3, wherein the value of the predetermined parameter is calculated as a sum of the square of the difference between the master fuel quantity increment and the standard fuel quantity increment and the square of the difference between the master fuel quantity decrement and the standard fuel quantity decrement.

5. The method according to claim 1, further comprising:

calculating a fuel quantity correction value as a difference between the first master injected fuel quantity to the minimum energizing time and the first injected fuel quantity to the reference energizing time; and correcting the standard characteristic curve based on the fuel quantity correction value.

6. A non-transitory computer readable medium comprising a computer program, which when run on a computer, is configured to execute the method according to claim 1.

7. A control apparatus for correcting a standard characteristic curve of a standard fuel injector used to inject metered quantities of fuel into an internal combustion engine, the control apparatus comprising an electronic control unit, a memory associated with the electronic control unit and a computer program having a computer-code, which when executed on the electronic control unit is configured to:

determine, from the standard characteristic curve, a first injected fuel quantity and a second injected fuel quantity corresponding to an incremended energizing time, which is higher than a reference energizing time by a time interval;

calculate a standard fuel quantity increment as the difference between the first and second injected fuel quantities;

determine, from a master characteristic curve of a master injector, a first master injected fuel quantity and a second master injected fuel quantity corresponding to a plurality of energizing times;

calculate, for each of the plurality of the energizing times, a master fuel quantity increment as the difference between the first and second master injected fuel quantities, a difference between the master fuel quantity increment and the standard fuel quantity increment and a value of a predetermined parameter as a function of at least one the difference;

identify; among the plurality of energizing times, a minimum energizing time for which the value of the predetermined parameter is a minimum;

calculate an energizing time correction value as a difference between the reference energizing time and the minimum energizing time; and correct the standard characteristic curve based on the energizing time correction value.

8. The control apparatus according to claim 7, wherein the value of the predetermined parameter is calculated as the square of the difference between the master fuel quantity increment and the standard fuel quantity increment.

9. The control apparatus according to claim 7, further comprising:

determine, from the standard characteristic curve, a third injected fuel quantity corresponding to a decremented energizing time, which is lower than the reference energizing time by the time interval;

calculate a standard fuel quantity decrement as the difference between the first and third injected fuel quantities;

determine, from the master characteristic curve, and for each one of the plurality of reference energizing times, a third master injected fuel quantity corresponding to the decremented energizing time; and calculate, for each one of the plurality of energizing times, a master fuel quantity decrement as the difference between the first and third injected fuel quantities, a difference between the master fuel quantity decrement and the standard fuel quantity decrement, and the value of the predetermined parameter as a function of both the difference between the master fuel quantity increment and the standard fuel quantity increment and the difference between the master fuel quantity decrement and the standard fuel quantity decrement.

10. The control apparatus according to claim 9, wherein the value of the predetermined parameter is calculated as a sum of the square of the difference between the master fuel quantity increment and the standard fuel quantity increment and the square of the difference between the master fuel quantity decrement and the standard fuel quantity decrement.

11. The control apparatus according to claim 7, further comprising:

calculate a fuel quantity correction value as a difference between the first master injected fuel quantity to the minimum energizing time and the first injected fuel quantity to the reference energizing time; and correct the standard characteristic curve based on the fuel quantity correction value.

* * * * *